US006000482A

United States Patent [19]

Michalski

[11] Patent Number: 6,000,482

[45] Date of Patent: Dec. 14, 1999

[54] DRILLING PIPE FOR DIRECTIONAL BORING

[76] Inventor: Joseph W. Michalski, 2320 E. County Rd., White Bear Lake, Minn. 55110

[21] Appl. No.: 08/869,113

[22] Filed: Jun. 4, 1997

[51] Int. Cl.[6] ..... E21B 17/02

[52] U.S. Cl. ..... 175/57; 175/61; 175/320; 228/168; 285/288.1

[58] Field of Search ..... 175/57, 61, 62, 175/45, 320; 285/115, 116, 288.1, 397, 382, 288.4, 288.5; 228/2.1, 2.3, 168

[56] References Cited

U.S. PATENT DOCUMENTS

| | | | |
|---|---|---|---|
| 1,344,221 | 6/1920 | Burns | 228/168 |
| 2,205,697 | 6/1940 | Scharpenberg | 175/320 X |
| 3,618,196 | 11/1971 | Sluetz | 29/470.3 |
| 3,784,235 | 1/1974 | Kessler et al. | 285/382 X |
| 3,825,083 | 7/1974 | Flarity et al. | 175/394 |
| 5,104,152 | 4/1992 | Galfant | 285/288.1 X |
| 5,211,100 | 5/1993 | Fuller et al. | 92/169.1 |
| 5,713,423 | 2/1998 | Martin et al. | 175/62 |

*Primary Examiner*—Hoang Dang
*Attorney, Agent, or Firm*—Quarles & Brady LLP

[57] ABSTRACT

An improved drilling pipe for directional boring uses a frictionally welded threaded coupling attached to pipe ends for connecting multiple pipes in a drill string. A stress spreader of the end coupling crosses the frictionally welded region to modify stresses on the weld. A weld flash receiving groove positioned beneath the weld allows the insert to be in place during the inertial welding operation and to be closely coupled to the interior pipe surfaces to receive forces therefrom.

5 Claims, 6 Drawing Sheets

DRILLING PIPE FOR DIRECTIONAL BORING

CROSS-REFERENCE TO RELATED APPLIATIONS

STATEMENT REGARDING FEDERALLY SPONSORED RESEARCH OR DEVELOPMENT

BACKGROUND OF THE INVENTION

The present invention relates to drilling pipe used in directional underground drilling, and the like, and in particular to an improved drilling pipe and method of fabrication of drilling pipe.

Directional drilling permits a bore hole to be cut through the earth with a curved trajectory. In such drilling, a steerable bit is attached to one end of length of drilling pipe. The drilling pipe is driven by a surface motor to rotate the bit and to provide a downward cutting pressure on the bit. The bore of the drilling pipe conducts water or drilling mud to the bit to clear it of earth and rock.

As the bit progresses beneath the surface of the earth, additional drilling pipe is attached to the exposed end of the previous drilling pipe to create a drilling string of increasing length. In order to allow connections of the drilling pipe to each other, the ends of the drilling pipe have threaded couplings. The threaded portions of the pipes are inset from the outer diameter of the pipe, necessitating an increased thickness of the pipe in the end regions.

One method of providing for this increased thickness is a forging of the pipe ends to greater wall thickness followed by a machining of the threads directly to the pipe. This process is expensive and time consuming.

In a second method, a separately machined and coupling is welded to the pipe to provide for the necessary thread interfaces. Normally a friction welding technique is used for this purpose to provide a high weld strength.

In friction welding, the coupling and pipe are rotated about their axes with respect to each other and then pressed together at an interface where the weld is to be formed. The friction between the parts generates heat and removes surface oxide providing for a fusion between the two materials. Weld flash produces a slight bulging at the interface between the two parts which may then be removed by the grinding operation.

In directional boring, the drill string may follow a curved radius on the order of 40 feet. When operating with such curved trajectories, the rotation of the drill string produces constantly changing stresses on the drilling pipes frequently causing failure of their welds.

BRIEF SUMMARY OF THE INVENTION

The present invention provides a stress shielding element spanning the weld in a drilling pipe. The element modifies the stress to which the weld is exposed, substantially increasing its life. The stress shielding element is in the form of an internal sleeve including a notch for accommodating the weld flash from the inertial welding process. The present inventors have determined that the sleeve may have a reduced diameter so as not to interfere with the relative rotation of the two components during that welding process, while still providing the necessary stress shielding.

Specifically, the present invention provides a drilling pipe for directional boring including an annular elongate pipe element having a pipe axis and an inner diameter. An end coupling is welded at a weld face to a first end of the pipe element to have its axial bore aligned with the pipe axis. A first coupling portion of the end coupling extends outward from the end coupling along the pipe axis. The end coupling also has a stress spreader with an outer diameter substantially equal to the inner diameter extending into the pipe element across the weld face. A weld flash receiving groove is cut into the end coupling aligned with the weld face when the end coupling is welded at the weld face. The weld flash receiving groove is sized to receive weld flash from a friction welding of the end coupling to the first end of the pipe element.

Thus it is one object of the invention to prolong the life of a welded drilling pipe in a way that does not interfere with an inertial welding operation. The use of the weld flash receiving groove allows expansion of molten welding material into the groove area without interference with the welding process and permits the outer diameter of the stress spreader in other areas to couple with stresses in the pipe element.

The end coupling may include a second coupling portion, opposed first coupling portion, and extending into the tube along the tube axis. The stress spreader may include a third coupling portion attachable to the second coupling portion with the stress spreader extending into the tube from the end coupling across the weld point. The second and third coupling portions may be mating, tapered pipe threads.

Thus it is another object of the invention to provide a method of constructing the end coupling of the present invention providing a weld flash receiving grooves adjacent to a weld face. Constructing the end coupling of two separable parts simplifies machining of an undercut pocket for receiving weld flash.

It is another object of the invention to find an assembly method for the two components of the end coupling that provides for good stress transfer. The pipe threads having a naturally wedging action permit a close coupling between the end coupling and the stress spreader.

The foregoing objects and advantages of the invention will appear from the following description. In the description, references are made to the accompanying drawings which form a part hereof and in which there is shown by way of illustration a preferred embodiment of the invention. Such embodiment does not necessarily represent the full scope of the invention, however, and reference must be made, therefore, to the claims for interpreting the scope of the invention.

DETAILED DESCRIPTION OF THE INVENTION

Figure 1:
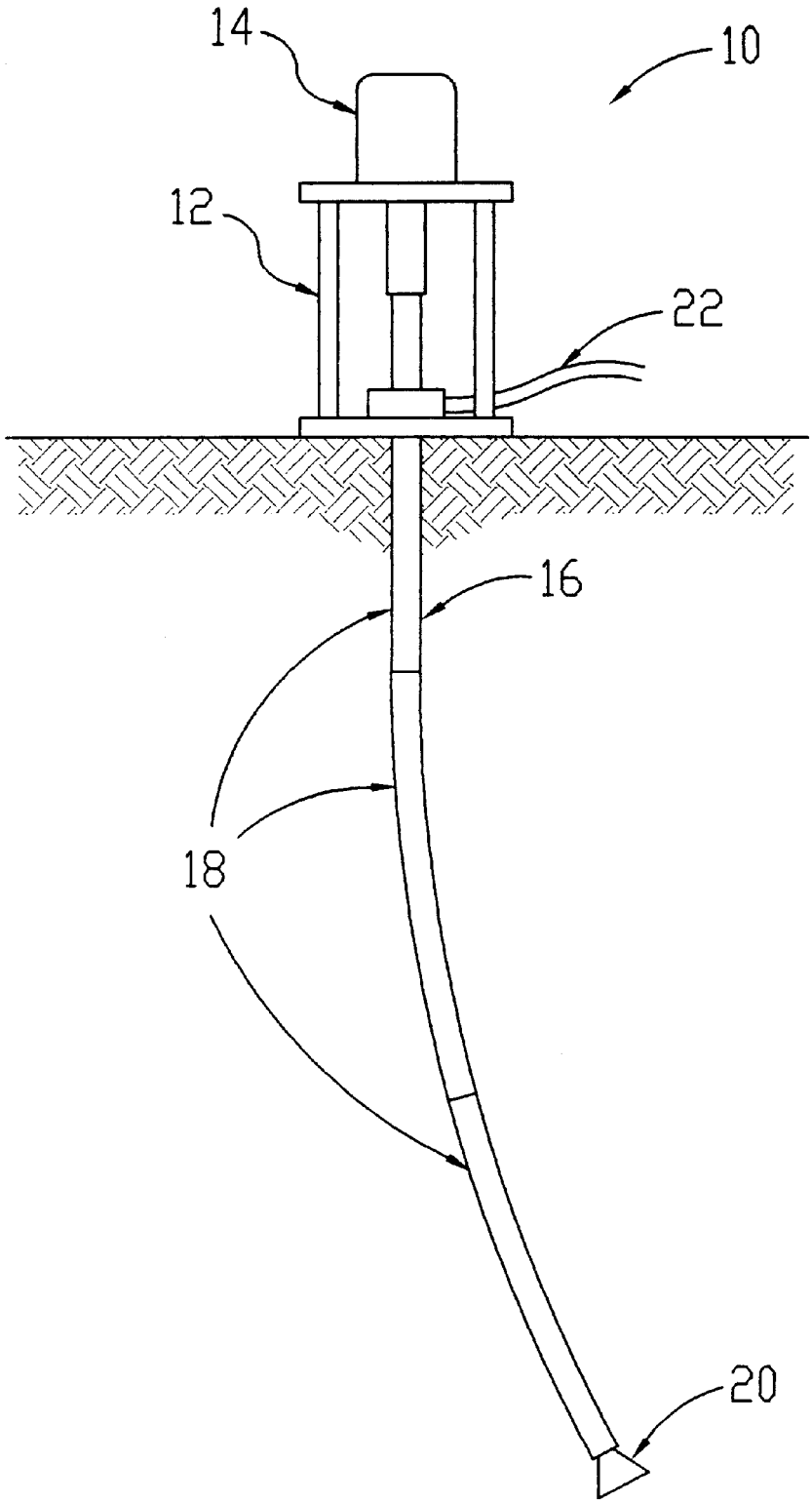
FIG. 1 is a simplified schematic view of a boring operation showing the connection of drilling pipes, head to tail, to form a drill string connecting a drill bit to a surface motor for rotating the same.

Referring to FIG. 1, a directional boring rig 10 includes a surface unit 12 having a motor 14 for rotating a drill string 16 composed of interconnected drilling pipes 18 terminating in a directional drill bit 20. The drilling pipes 18 define a continuous central bore (not shown) that receive a cutting fluid from surface supply 22 and conducts the fluid to the drill bit 20. During directional boring, the drill string 16 follows a curved trajectory.

Figure 2:
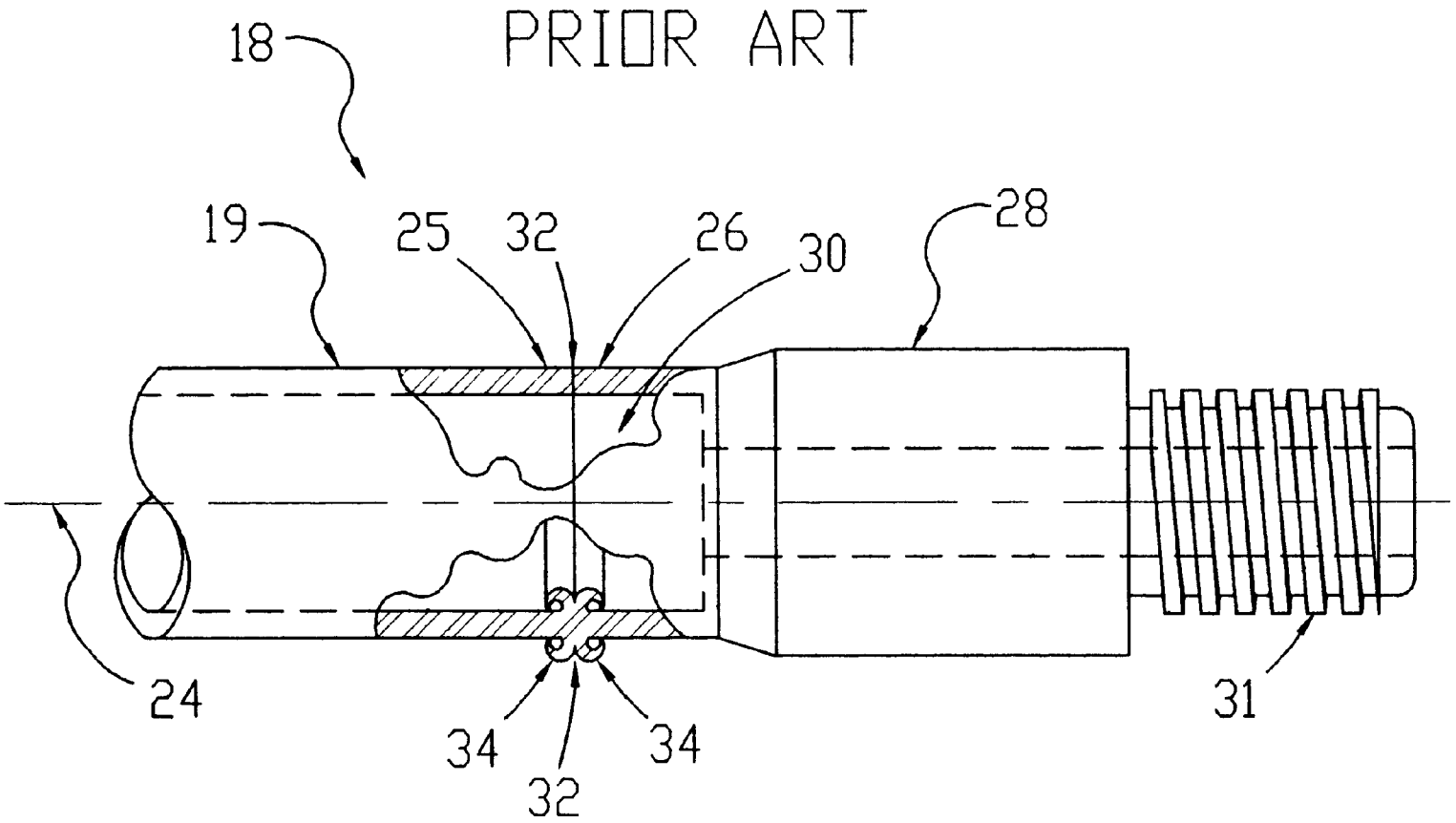
FIG. 2 is a fragmentary view of an end of a drilling pipe and its component end coupling and pipe element, with cutaway portions showing the two parts before friction welding and after friction welding, and in the latter case, showing weld flash produced by the friction welding.

Referring now to FIG. 2, a prior art drilling pipe 18 includes a pipe element 19 formed of high tensile strength steel. The pipe element 19 is cut square to its axis 24 at cut pipe end 25 to abut a radially extending flange 26 of an end coupling 28, the latter having a central bore 30 aligned and communicating with the bore of the pipe element 19.

A threaded first coupling portion 31 of the end coupling 28 extends outward from the end coupling 28 along the axis 24 away from the pipe element 19. The threaded portion 31 may have either external or internal threading depending on the end of the pipe element 19 to which it is attached. To form the drill string (shown in FIG. 1), an end of the drilling pipe 18 with external threading is joined to an end of a second drilling pipe 18 with internal threading. The bore 30 extends through the threaded portion 31.

Generally, the threaded portion 31 has an outer diameter less than the outer diameter of the pipe element 19 or end coupling 28 so as to permit a smooth outer contour of the drill string 16 when several drilling pipes 18 are connected.

The end coupling 28 is welded to the pipe element 19 by frictional welding. In this process, end coupling 28 is rotated about axis 24 with respect to pipe element 19, and then the flange 26 is pressed against the cut pipe end 25 at a weld interface 32 so that friction and mechanical abrasion provide for a clean fusing of the materials of pipe element 19 and end coupling 28.

After welding is complete, the weld interface 32' is surrounded by weld flash 34 shown as a bulge extending on each side of the weld interface 32'. The weld flash 34 on the outside of the weld is removed by a machining operation.

Figure 3:
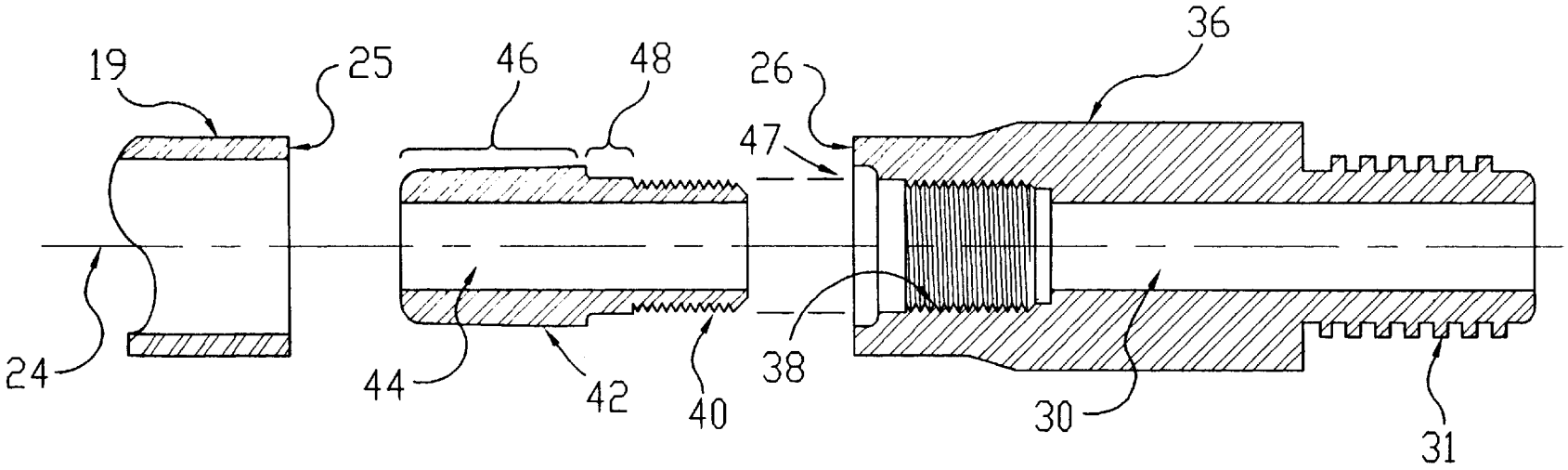
FIG. 3 is a cross sectional view taken along the drilling pipe of the present invention showing the end coupling separated from its stress spreader.

Referring now to FIG. 3 in the present invention an improved end coupling 36 is provided having a similar threaded portion 31, bore 30, and weld flange 26 as the end coupling 28 of FIG. 2. End coupling 36 differs from the end coupling 28 of FIG. 2 in that the bore 30 toward the weld flange 26 includes a second coupling portion 38 consisting of internally cut tapered pipe threads. The pipe threads 38 are sized to receive a corresponding third coupling portion 40 consisting of externally threaded pipe threads on a stress spreader 42. Threads 38 and 40 permit the stress spreader 42 to be tightly attached to the end coupling 36 to extend axially away from threaded portion 31.

Figure 4:
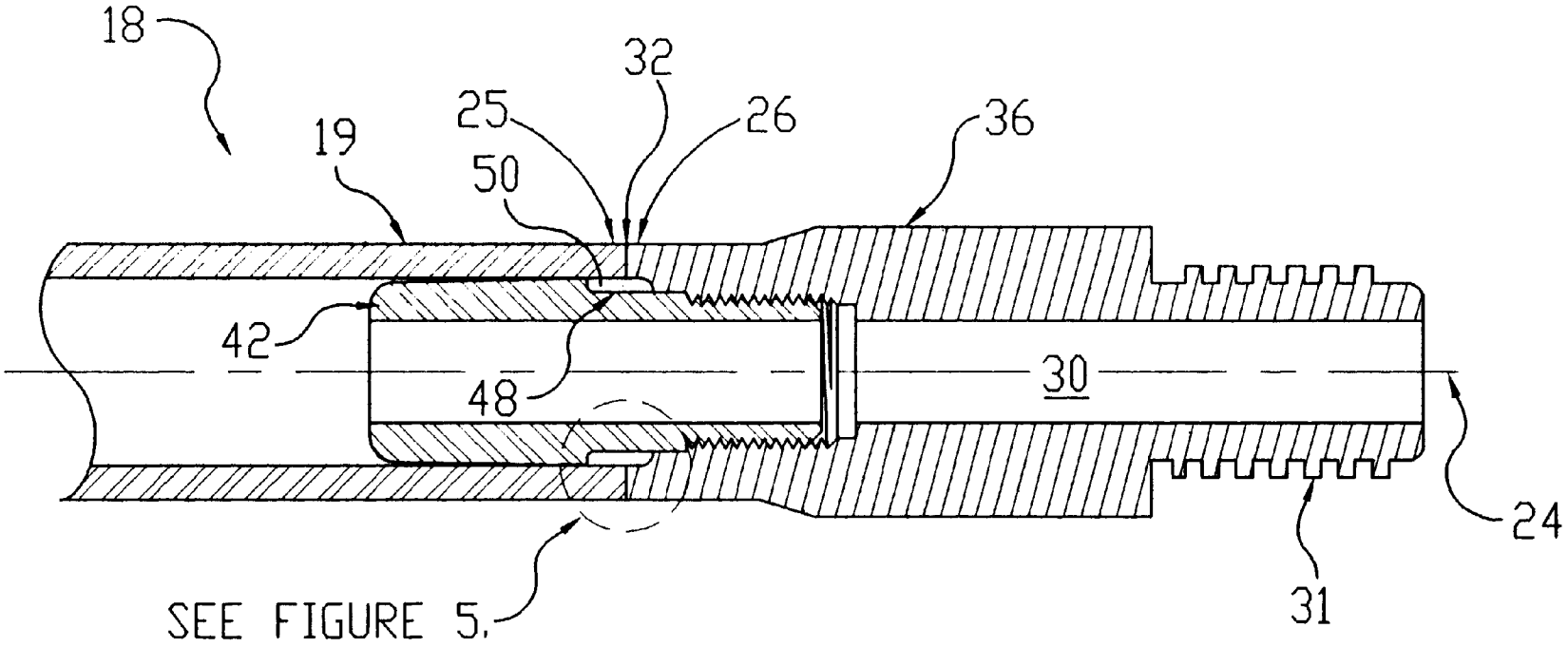
FIG. 4 is a cross sectional view similar to FIG. 3 of the end coupling assembled with its stress spreader and positioned within a pipe element prior to frictional welding.

The stress spreader 42 is generally cylindrical in shape with a central bore 44 aligning with bore 30 when the stress spreader 42 and end coupling 36 are threaded together. When so assembled, and when the end coupling 36 is positioned for welding to pipe element 19 (as shown in FIG. 4), a contacting portion 46 of the outer diameter of the stress spreader 42 extends axially beyond the flange 26 and into the pipe element 19. The outer diameter of the contacting portion 46 is substantially equal to the inner diameter of the pipe element 19 with a clearance of approximately 0.0015". This clearance has been determined to provide sufficient clearance between the contacting portion 46 and the inner diameter of the pipe element 19 to permit the inertial welding of the pipe element 19 to the end coupling 36 while still allowing the stress spreader to function in increasing the strength of the drilling pipe 18'.

Figure 5:
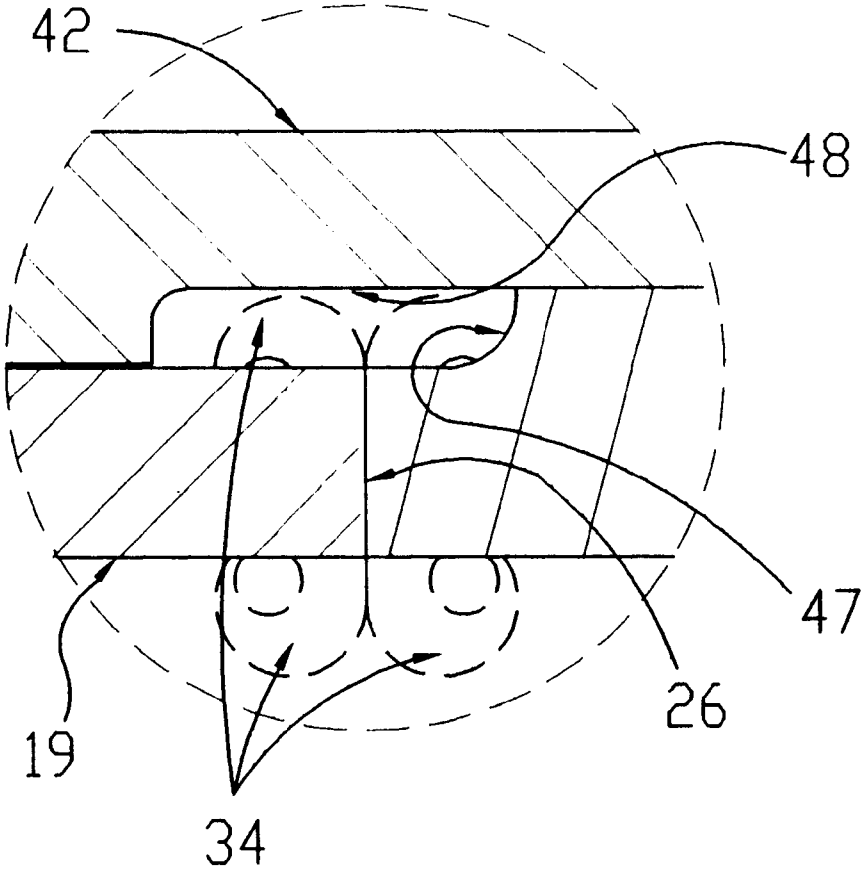
FIG. 5 is a detailed view of the interface between the pipe element and the end coupling of FIG. 4 showing the weld flash receiving groove formed by the stress spreader and end coupling as is positioned beneath the weld face.

Referring now to FIGS. 3, 4, and 5, an axial counterbore 47 aligned with bore 30 is cut inside of radially extending flange 26. When the end coupling 36 is assembled to the pipe element 19 (as shown in FIGS. 4 and 5), the counterbore 47 provides an undercut beneath the flange 26. When stress spreader 42 is connected with the end coupling 36, the counterbore 47 is positioned over a reduced diameter section 48 of the stress spreader 42 together to form a weld flash receiving groove 50. The reduced diameter section 48 of the stress spreader 42 separates the threads 40 from the contacting portion 46.

The weld flash receiving groove 50 thus formed is centered about the weld interface 32 beneath flange 26 to receive weld flash 34 indicated by the dotted lines in FIG. 5. By receiving the weld flash 34, inertial welding may be accomplished without interference from the stress spreader 42.

Referring now to FIG. 4, a drilling pipe may be assembled by the following steps. First, end coupling 36 is threaded to stress spreader 42 so that the reduced diameter section 48 is positioned beneath flange 26. The stress spreader 42 is then inserted into pipe element 19 and end coupling 36 moved until flange 26 is an abutment with the cut pipe end 25. End coupling 36 is then rotated rapidly about common axis 24 with respect to the pipe element 19 and then pressed against pipe element 19 to form a frictional weld between flange 26 and cut pipe end 25 with flash 34 filling the weld flash receiving groove 50 formed as previously described. The outer flash 34 may then be removed by a grinding operation.

While the inventors do not wish to be bound to a particular theory, it is believed that the closed coupling between the end coupling 36 and the stress spreader 42 bridging the weld interface 32 serve to transmit certain tensile stresses to regions outside of the weld interface 32 or to stresses on the weld interface 32 to modes in which the weld has greater strength. The slight clearance between the contacting portion 46 of the stress spreader 42 and the interior dimension of the pipe element 19 permits frictional welding yet provides sufficient stress shielding to significantly increase strength of the welded assembly.

Figure 6:
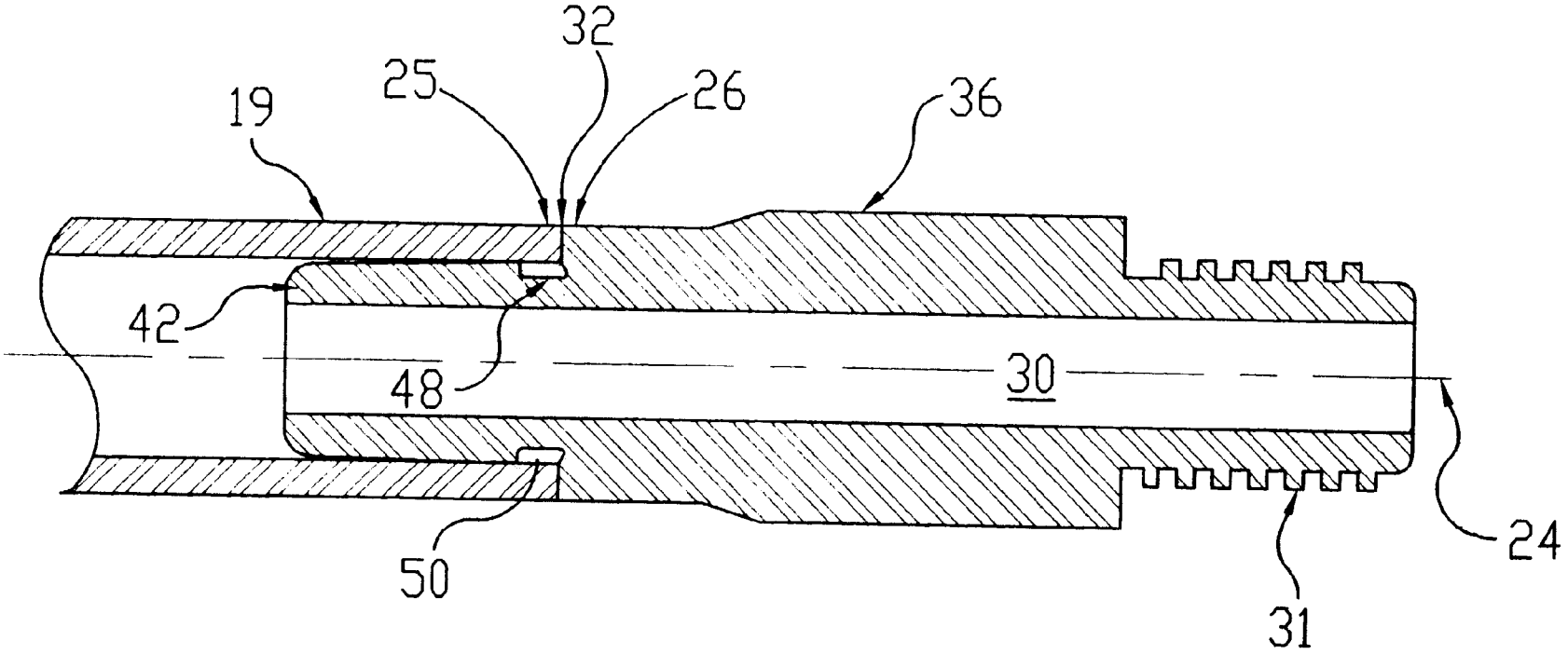
FIG. 6 is a view similar to that of FIG. 4 showing an alternative embodiment of the invention wherein the end coupling and stress spreader are a single unit.

Referring now to FIG. 6, in an alternative embodiment, the stress spreader 42 is integrally formed with the end coupling 36 such as may be done by cutting the two from a single piece of bar stock on a metal lathe as will be understood in the art. Similarly, it will be recognized that the end coupling may be joined to the stress spreader 42 by a number of other techniques including interference fits such as press or shrink fits or with adhesives such as epoxy.

The above description has been that of a preferred embodiment of the present invention. It will occur to those that practice the art that many modifications may be made without departing from the spirit and scope of the invention. In order to apprise the public of the various embodiments that may fall within the scope of the invention, the following claims are made.

I/we claim:

1. A drilling pipe for directional boring comprising:

a pipe having a pipe axis and an inner diameter;

an end coupling welded at a weld face to a first end of the pipe having an axial bore aligned with the pipe axis, the end coupling having a first coupling portion extending outward away from the pipe along the pipe axis and a second coupling portion opposed to the first coupling portion and extending along the pipe axis;

a stress spreader having a third coupling portion and an outer diameter substantially equal to the inner diameter of the pipe extending into the pipe across the weld face;

wherein the end coupling and the stress spreader are connected at mating threads on the second and third coupling portions and form a weld flash receiving groove aligned with the weld face to receive the weld flash from a friction welding of the end coupling to the first end of the pipe, the weld flash receiving groove having at least one edge sized to fit within the inner diameter of the pipe.

2. The drilling pipe of claim 1 wherein the second and third coupling portions have tapered pipe threads.

3. A drilling pipe for directional boring comprising:

a pipe having a pipe axis and an inner diameter;

an end coupling welded at a weld face to a first end of the pipe having an axial bore aligned with the pipe axis, the end coupling having a first coupling portion extending outward away from the pipe along the pipe axis and a second coupling portion opposed to the first coupling portion and extending along the pipe axis;

a stress spreader having a third coupling portion and an outer diameter substantially equal to the inner diameter of the pipe extending into the pipe across the weld face;

wherein the end coupling and the stress spreader are connected by an interference fit between the second and third coupling portions and form a weld flash receiving groove aligned with the weld face to receive the weld flash from a friction welding of the end coupling to the first end of the pipe, the weld flash receiving groove having at least one edge sized to fit within the inner diameter of the pipe.

4. A drilling pipe for directional boring comprising:

a pipe having a pipe axis and an inner diameter;

an end coupling welded at a weld face to a first end of the pipe having an axial bore aligned with the pipe axis, the end coupling having a first coupling portion extending outward away from the pipe along the pipe axis and a second coupling portion opposed to the first coupling portion and extending along the pipe axis;

a stress spreader having a third coupling portion and an outer diameter substantially equal to the inner diameter of the pipe extending into the pipe across the weld face;

wherein the end coupling and the stress spreader are connected by an adhesive between the second and third coupling portions and form a weld flash receiving groove aligned with the weld face to receive the weld flash from a friction welding of the end coupling to the first end of the pipe, the weld flash receiving groove having at least one edge sized to fit within the inner diameter of the pipe.

5. A method of manufacture of a drilling pipe for directional boring from a pipe having a pipe axis and an inner diameter, comprising the steps of:

(a) assembling an end coupling having a first coupling portion and opposed second coupling portion to a stress spreader having an outer diameter substantially equal to the inner diameter, and the stress spreader having a third coupling portion that connects to the second coupling portion to form a weld flash receiving groove having at least one edge sized to fit within the inner diameter of the pipe;

(b) inserting the stress spreader into one end of the pipe so that the end coupling abuts the pipe end at a weld face and so that the weld flash receiving groove is substantially aligned with the weld face; and (c) frictionally welding the end coupling to the pipe at the weld face.

* * * * *